United States Patent [19]

Newman et al.

[11] Patent Number: 4,813,203

[45] Date of Patent: Mar. 21, 1989

[54] RETROFIT GLAZING SYSTEM

[75] Inventors: George E. Newman; Hugo J. Palacios; Jerry C. Hogan, all of Houston, Tex.

[73] Assignee: NPH Partnership, Houston, Tex.

[21] Appl. No.: 98,419

[22] Filed: Aug. 19, 1987

[51] Int. Cl.[4] ..... E04B 2/88; E04G 21/00

[52] U.S. Cl. ..... 52/204; 52/235; 52/477; 52/656; 52/745

[58] Field of Search ..... 52/235, 202, 203, 207, 52/208, 301, 398, 475–477, 656, 745, 204; 49/501, 504, 463–466

[56] References Cited

U.S. PATENT DOCUMENTS

| | | | |
|---|---|---|---|
| 2,666,508 | 1/1954 | Nardulli | 52/656 |
| 4,307,551 | 12/1981 | Crandell | 52/235 |
| 4,483,122 | 11/1984 | Crandell | 52/235 |
| 4,543,755 | 10/1985 | Crandell | 52/235 |
| 4,633,631 | 1/1987 | Crandell | 52/235 |
| 4,656,778 | 4/1987 | Fiorenza | 49/501 |

FOREIGN PATENT DOCUMENTS

| | | | |
|---|---|---|---|
| 2381888 | 9/1978 | France | 52/203 |

*Primary Examiner*—James L. Ridgill, Jr.
*Attorney, Agent, or Firm*—Gun & Nichols

[57] ABSTRACT

Disclosed is a retrofit glazing system having a sub-frame mountable to the framework of an existing glazing system of a building. The sub-frame cooperates with an interlocking miniframe bonded to a glazing panel. The sub-frame and interlocking miniframe and glazing panel are installed from the exterior of the building. In an alternate embodiment, the sub-frame is bonded to the glazing panel and is installed from the interior of the building.

10 Claims, 4 Drawing Sheets

RETROFIT GLAZING SYSTEM

BACKGROUND OF THE DISCLOSURE

The present invention is directed to an improved glazing installation system, particularly, a system for retrofit installation of the exterior panels of an existing window, sloped glazing and/or skylight system in a building or the like.

Glazing framing systems for buildings are very common and in extensive use. In such systems, structural members such as heads, sills, jambs, rafters, purlings and mullions form the structural framework for supporting glass panels or the like to form the glazing system. Glazing systems include window, skylight, sloped glazing and curtain wall systems. Typically, the structural framework includes interior and exterior frame members. In a window system, glass panels are retained between the interior and exterior frame members to form the completed window system. The interior and exterior frame members are connected together by variouus means for securely gripping and supporting the glass panels. Seals or gaskets are typically installed along the connection to affect a water and air tight seal between the frame members and the glass panels.

While the following description of the retrofit glazing system and method of installation will describe the retrofit of building window systems, it is understood that the invention and method of the present disclosure may be used with a variety of glazing systems, including window, skylight, sloped glazing and curtain wall systems.

A common problem encountered with window systems is the intrusion of water and air past the gasket seals and/or the exterior framing joinery into the building interior. Rainwater, condensation and water from window washing are the typical sources of water intrusion into the building interior. Buildings encounter this problem due to defective or faulty installation of the window system or simply the deterioration due to the passage of time. After a period of time, the glass panel gasket seals in a window system become brittle and fail. The gasket seals may also be weakened by ultraviolet rays, thereby substantially reducing their sealing effectiveness. Gasket seals are also abraded by particles in the air and by routine maintenance, such as window washing. Consequently, in a relatively short period of time extensive maintenance is required to repair or replace the window system of a building, which maintenance may include the replacement of recaulking of the window seals.

A significant problem associated with the repair or replacement of a window system is that it often requires that the repairs be made from both the interior and the exterior of the building. This is usually objectionable to the occupants of the building which are inconvenienced by the interruption in their daily routine or work schedule and economically unfeasible to the building owner.

It is, therefore, an object of the present disclosure to provide a system which may be retrofit into an existing freamework glazing of a building.

It is a further object of this invention is to provide a retrofit glazing system which may be completely installed from the exterior of the building.

It is yet another object of this invention to provide a method of installing the retrofit glazing system.

It is yet another object of this invention to eliminate exterior exposed metal framing about a window opening. This is accomplished by mounting the window glass on the window frame so that it is retained thereon solely by structural silicone adhesive thereby eliminating a source of further leaks.

SUMMARY OF THE INVENTION

The invention of the present disclosure is directed to a retrofit glazing system installed in an existing glazing system of a building. The system includes an extruded sub-frame which is installed from the exterior of a building onto the preexisting framing system of the building. An extruded interlocking miniframe mounted on a glazing panel, such as a glass panel, cooperates with the sub-frame permitting the installation of the glass panel from the exterior of the building. A structural adhesive silicone sealant permanently bonds the miniframe to the glass panel. The exterior metal and existing perimeter seal are replaced by a glass to substrate weather seal to complete the installation.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

Figure 1:
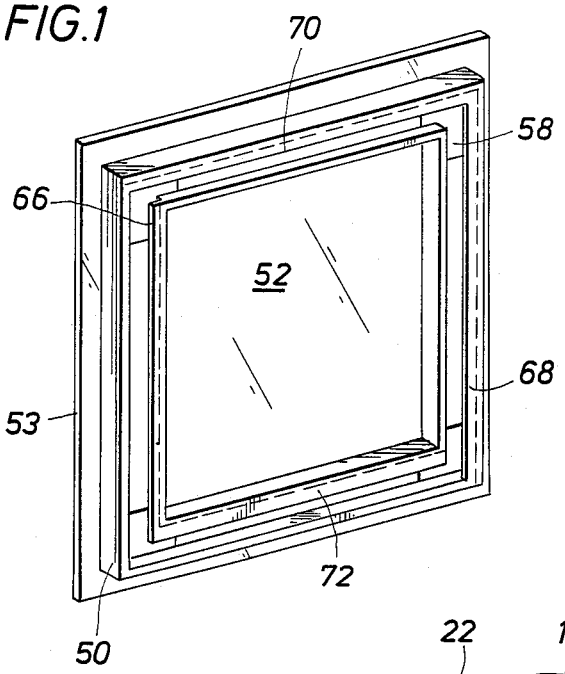
Figure 2:
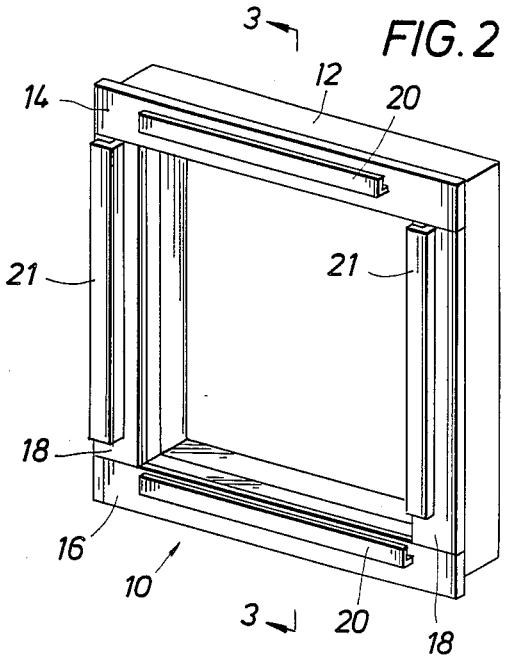
Figure 3:
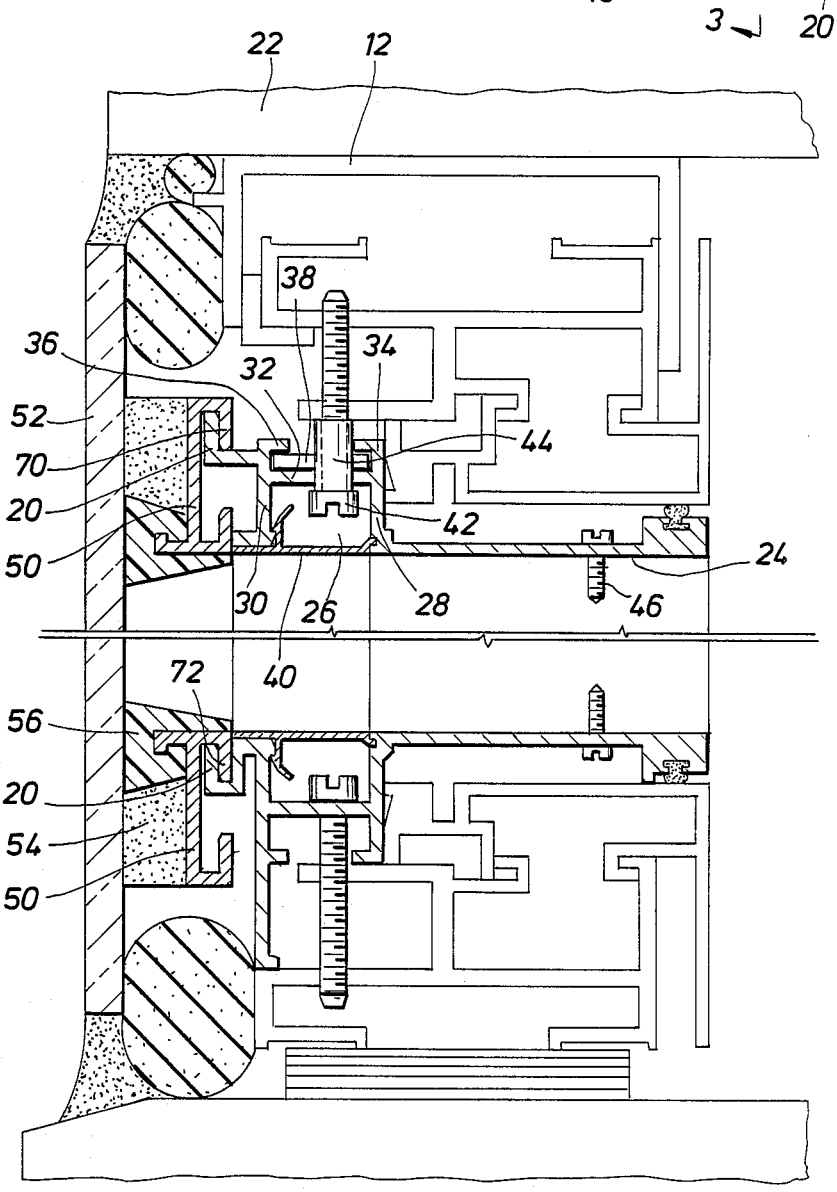
Figure 4:
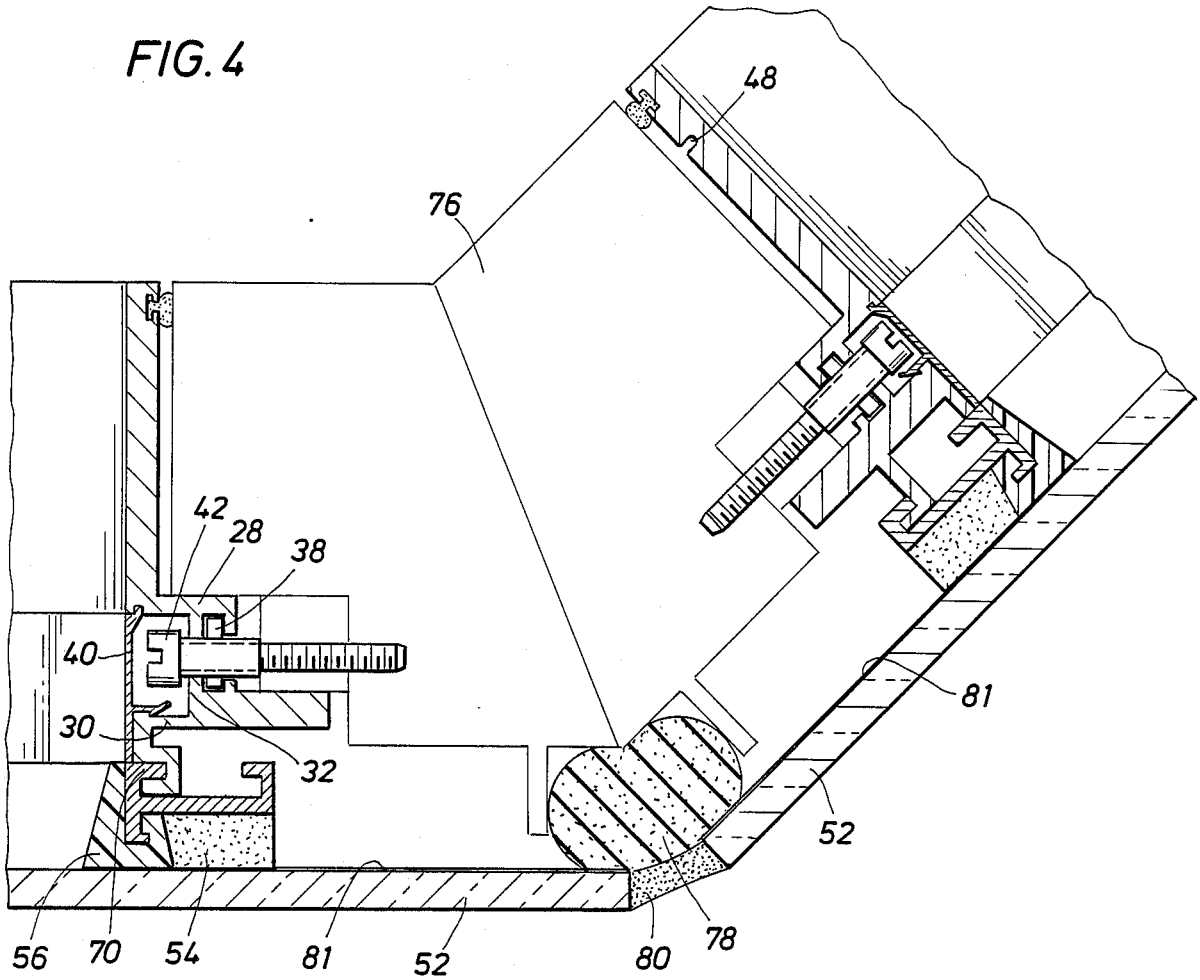
Figure 5:
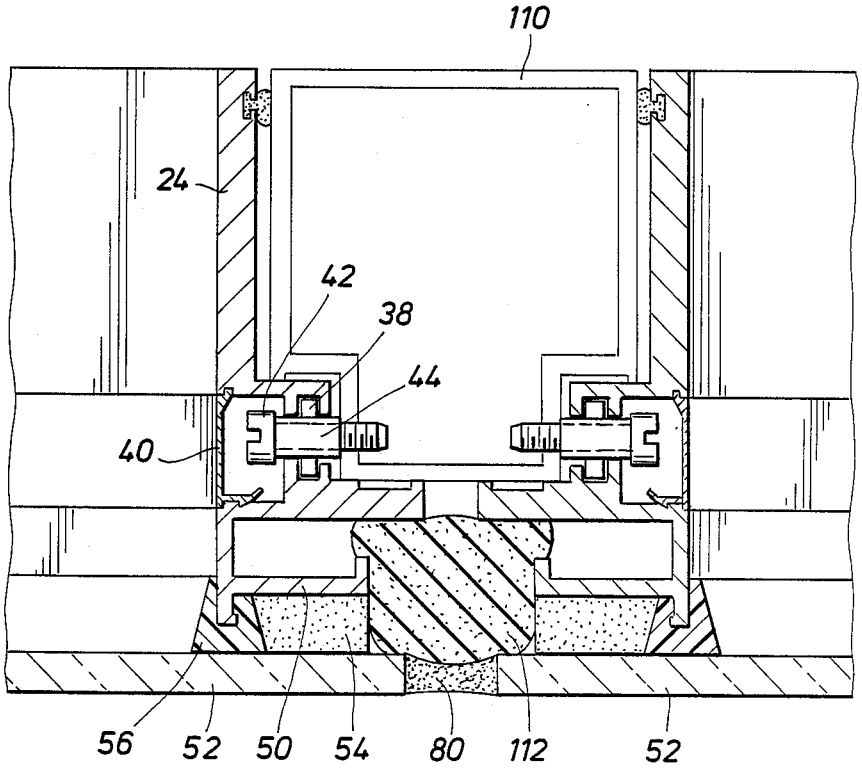
Figure 6:
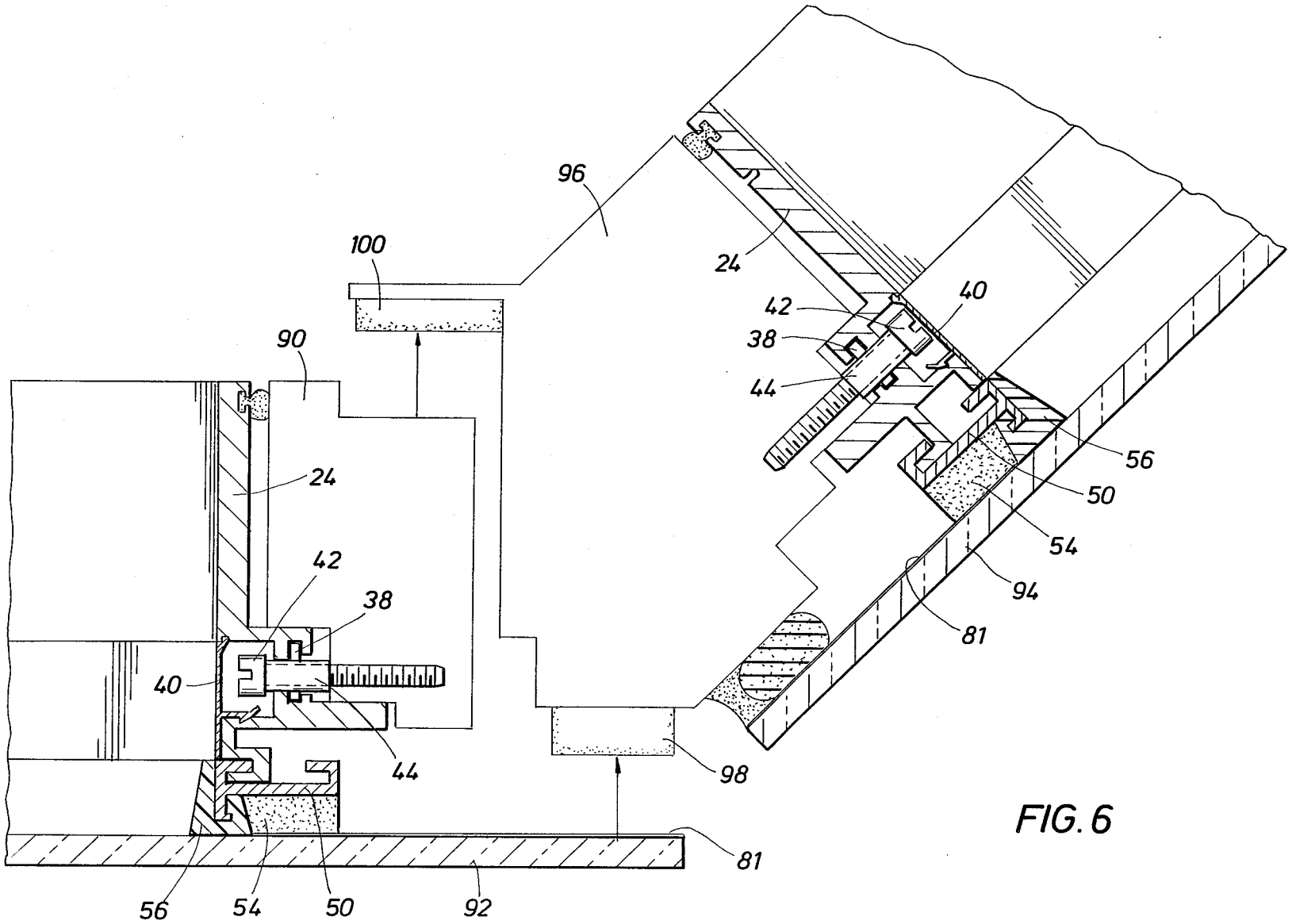
Figure 7:
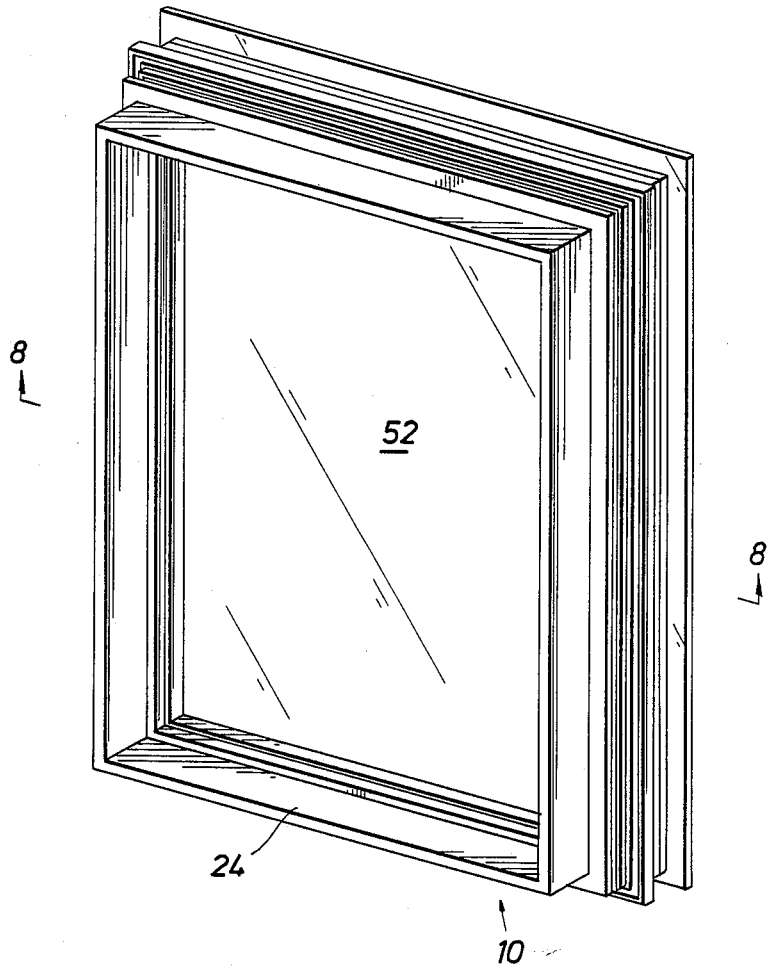
Figure 8:
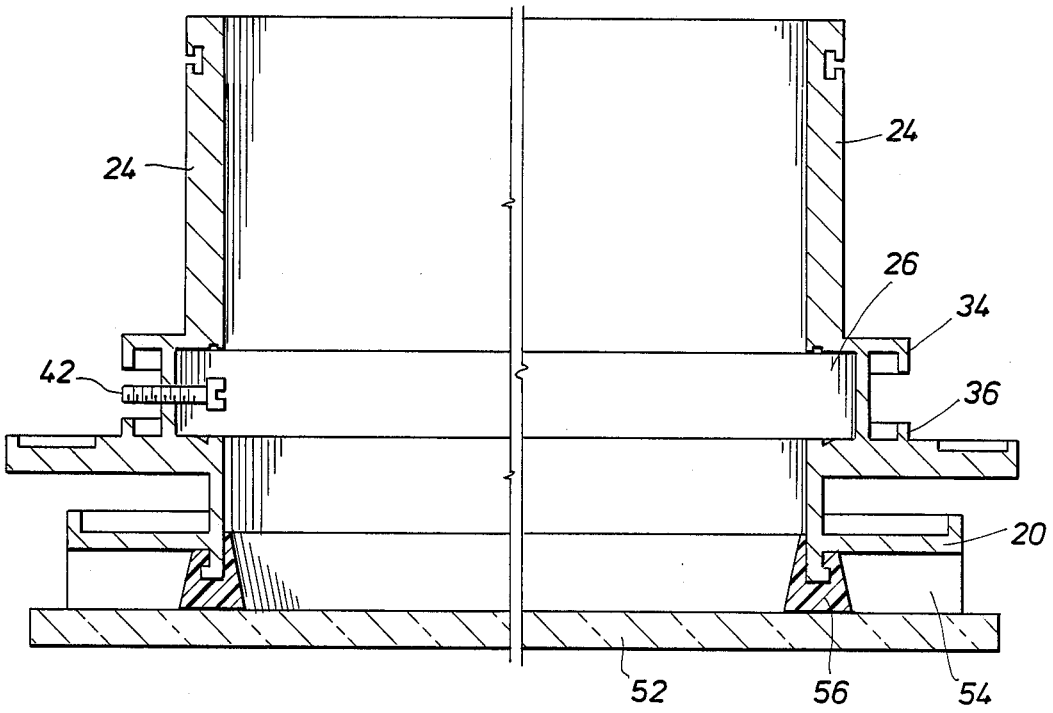

FIG. 1 is a perspective view of a glass panel having the interlocking miniframe of the invention mounted thereo;

FIG. 2 is a perspective view of the sub-frame of the invention;

FIG. 3 is a sectional view of the sub-frame of the invention taken along line 3—3 of FIG. 2 and showing a sectional view of the glass panel and miniframe of the invention mounted thereon;

FIG. 4 is a sectional view of the window system of the invention at a corner mullion of a bay window;

FIG. 5 is a partial sectional view on alternate embodiment of the window system of the invention showing glass panels mounted directly to the sub-frame of the invention;

FIG. 6 is a partial sectional view of the window system of the invention supporting an operating window;

FIG. 7 is a perspective view of an alternate embodiment of the invention showing the sub-frame bonded to a glass panel; and FIG. 8 is a sectional view taken along line 8—8 of FIG. 7.

DETAILED DESCRIPTION OF THE PREFERRED EMBODIMENT

The existing window or the like system of a building typically includes a supporting framework defining the window opening and interior and exterior frame members detachably connected to the window framework and cooperating with gasket seals for gripping and supporting the glass panels. Prior to installation of the invention of the present disclosure, the existing glass panels, gasket seals and interior and exterior frame members of the window system are removed exposing the existing window system framework. Removal of these existing window frame members is accomplished completely from the exterior of the building.

Referring first to FIG. 2, the sub-frame of the invention, generally identified by the reference numeral 10, is shown mounted to an existing window system framework 12. For the sake of convenience and clarity, the framework 12 is shown removed from the surrounding wall system of the building. The framework 12 is typically metal framing which is mounted to the building structural members to form the window opening. The sub-frame 10 of the invention comprises a head 14, sill 16 and mullions 18 connected at the ends thereof to form the sub-frame 10. Projecting from the head 14, sill 16, and mullions 18 are L-shaped flange members 20 and 21 which form a discontinuous channel about the sub-frame 10.

In FIG. 3, the original framework 12 is shown mounted to a surrounding wall 22. The framework 12 may have any number of configurations. In FIG. 3, one configuration, exemplary of a typical existing window framework is shown. The sub-frame 10 of the invention is adapted to mate with and cover the existing framework 12. The sub-frame 10 is formed, for example, by extruded aluminum members joined end-to-end defining the window opening. In sectional view, as best shown in FIG. 3, the extruded frame members include a flat portion 24 which extends inwardly to cover the innermost edge of the existing framework 12. The flat portion 24 terminates at a reveal channel 26 formed by wall members 28 and 30 and a bottom member 32. The wall members 28 and 30 include extensions 34 and 36, respectively, which are L-shaped in cross-section and define a slot for receiving a leg member of a corner bracket 38. The open channel 26 is closed by a snap-in filler 40 after the sub-frame 10 is mounted to the framework 12. The sub-frame 10 is mounted to the framework 12 by fasteners 42 which extend through the bottom 32 of the channel 26 and into the framework 12. A spacer 44 is journaled about the fastener 42 thereby permitting the sub-frame 10 to be adjusted slightly in the event the window opening is not perfectly square and to allow for thermal expansion movements.

The L-shaped flange members 20 and 21 projects outwardly from the wall member 30 and are integrally formed therewith. The head 14, sill 16 and mullions 18 of the sub-frame 10 are extruded single pieces joined at the corners thereof by the brackets 38. Additionally, the head 14 and sill 16 are anchored to the mullions 18 by screws 46 which extend through the flat portion 24 of the head 14 and sill 16 and are received in longitudinal grooves 48 formed in the mullions 18 as best shown in FIG. 4. Upon completion of the assembly, the sub-frame 10 is a rigid frame which is slid into the window opening from the exterior of the building and mounted to the existing framework 12 as described above.

Referring now to FIG. 1, the miniframe of the invention identified by the numeral 50 is shown bonded to the glass panel 52. The miniframe 50 is bonded to the panel 52 prior to installation on the sub-frame 10. The miniframe 50 is bonded to the panel 52 with structural adhesive silicone sealant 54. An extruded silicon compatible trim 56 about the internal periphery of the miniframe 50 provides an interior seal and trim. The frame members forming the miniframe 50 are temporarily held together by corner connectors 58 which enable the miniframe 50 to be squared as it is bonded to the panel 52.

The miniframe 50 defines a channel about the periphery thereof formed by inwardly extending flange members. The flange members or the miniframe 50 cooperate with the flange members 20 and 21 on the sub-frame 10 to secure the glass panel 52 thereon. It will be observed in FIG. 2 that the vertically extending flange members 21 on the mullion 18 define a channel opening to the left. The horizontally extending flange members 20 on the head 14 and sill 16 define an upwardly opening channel. On the miniframe 50, the vertical flange members 66 and 68 define a channel opening to the left as shown in FIG. 1. The horizontal flange members 70 and 72 define a channel opening downwardly. Upon assembly, the miniframe 50 and glass panel 52 are positioned on the sub-frame 10 so that the flange members 66 and 68 are received within the channels formed by the flange members 21 on the mullions 18. Likewise, the flange members 70 and 72 are received within the channels formed by the flange members 20 on the head 14 and sill 16. Mounting of the glass panel 52 to the sub-frame 10 is accomplished by interlocking the miniframe 50 with the sub-frame 10. To this end, the miniframe 50 is slid into position so that the miniframe 50 and glass panel 52 are supported by the flange members 20 on the head 14 and sill 16. The miniframe 50 is then slid slightly to the right on the sub-frame 10 shown in FIG. 2 so that the flange members 66 and 68 are received within the channels defined by the flange members 21 on the mullions 18. When the miniframe 50 is properly positioned, a perimeter seal about the window opening defined by the sub-frame 10 is established by the internal seal 56 mounted on the miniframe 50.

Upon completion of the installation which is accomplished from the exterior of the building, the glass panel 52 is sealed about its peripheral edge 53 to the surrounding building substrate. The building substrate may be brick, concrete, wood or other type of building material. In FIG. 4, adjacent glass panels 52 are sealed along a bay window mullion 76. A backer rod 78 is positioned behind the glass panels 52 at the juncture thereof providing a backing surface for the structural adhesive silicon sealant 80 which fills the gap between the adjacent panels 52. The sealant 80 is smoothed out and any excess is removed from the glass panels 52 so that a clean and neat appearance is presented. In the event a transparent or translucent panels 52 are utilized, an opacifier or reflective coating 81 is applied to the back surface of the panels 52 so that the underlying window support structure 76 is not visible.

Referring now to FIG. 6, the system of the invention is shown mounted to an operating window. In FIG. 6, the sub-frame 10 and miniframe 50 are mounted to the existing window framework in the manner previously described. The sub-frame 10 is mounted to the previously existing movable mullions 90 in the arrangement shown. In FIG. 6, the glass panel 92 forms the operating window. That is, the panel 92 may be opened in the usual fashion. The glass panel 94, however, is bonded to the stationary mullion 96. It is understood however that the window 94 could also be an operating window if desired. Upon closing the operating window 92, a seal is provided about the window 92 and the mullion 90 by the seals 98 and 100.

Referring now to FIGS. 7 and 8, an alternate embodiment of the window installation of the present disclosure is shown. Installation of the window system described herein is simplified when access to the interior of the building is available. Under those circumstances, the miniframe 50 is not required and therefore the sub-frame 10 is bonded directly to the glass panel 52. First, as previously discussed, the sub-frame 10 is extruded to the shape and size required to match the existing framework 12. The sub-frame 10 is then bonded to the glass panel 52. The panel 52 and sub-frame 10 mounted thereon are then inserted into the window opening and the sub-frame 10 is mounted to the window framework by fasteners 42. Thereafter, the glass panel 52 is sealed about its periphery along the exterior to the surrounding building structure.

In FIG. 5, a sectional view is shown of adjacent panels 52 mounted to a center mullion 110. The installation includes a backer rod 112 positioned behind the glass panels 52, providing a backing for the structural adhesive silicon sealant 80 which fills the gap and seals between the panels 52.

The retrofit glazing system of the present disclosure provides a very economical and time saving system for repairing existing building window systems. Installation is accomplished by first taking precise measurements of the existing window opening and then fabricating a sub-frame 10 and miniframe 50 unique to a particular window opening. Fabrication of the sub-frame 10 and the miniframe 50 is completed at the shop and delivered to the building ready for installation. Thereafter, the old window assembly is removed, leaving only the window framework 12. The sub-frame 10 is then mounted to the window framework 12, if it is an exterior installation, and the miniframe 50 and glass panel 52 are thereafter interlocked to the sub-frame 10. The glass panel 52 is sealed about the perimeter thereof to the surrounding building substrate to complete the installation. Installation of the system of the present invention is completed within a matter of hours after the original window assembly is removed.

It will be understood that certain combinations and subcombinations are of utility and may be employed without reference to other features and subcombinations. This is contemplated by and is within the scope of the present invention.

As many possible embodiments may be made of this invention without departing from the spirit and scope thereof. It is to be understood that all matters hereinabove set forth or shown in the accompanying drawings are to be interpreted as illustrative and not in any limiting sense.

While the foregoing is directed to the preferred embodiment, the scope thereof is determined by the claims which follow.

What is claimed is:

1. A retrofit glazing system for installation on the framework of a glazing system of a building structure, comprising:

(a) a sub-frame mounted to the existing glazing framework, said sub-frame comprising a substantially rectangular unitary frame formed by a plurality of frame members joined end-to-end defining an opening, said sub-frame being sized for retrofit installation in the existing glazing framework;

(b) a miniframe bonded to a glazing panel cooperating with said sub-frame for securing said miniframe and glazing panel to said sub-frame; and (c) mounting means for mounting said sub-frame to the existing glazing framework.

2. The system of claim 1 wherein structural adhesive silicon sealant bonds said miniframe to the glazing panel.

3. The system of claim 2 wherein said miniframe includes interior seal means formed by an extruded silicon compatible trim providing an interior seal between the glazing panel and said miniframe.

4. The system of claim 1 wherein said miniframe includes connector means for mounting said miniframe on said sub-frame.

5. The system of claim 4 wherein said connector means comprises peripheral flange members extending from said miniframe for interlocking engagement with channel means formed on said sub-frame.

6. The system of claim 1 wherein said plurality of frame members include an inwardly extending flat portion for covering the existing glazing framework, said flat portion terminating at an open channel defined by a pair of spaced wall members connected by a bottom member.

7. The system of claim 6 wherein said open channel is enclosed by a snap-in cover.

8. The system of claim 6 including a pair of opposed extensions extending from said spaced wall members beyond said bottom member of said open channel, said opposed extensions defining a slot for receiving bracket means for locking said plurality of frame members in end-to-end engagement.

9. The system of claim 8 including flange members projectig outwardly from at least one of said spaced wall members and integrally formed therewith, said flange members defining an open discontinuous channel about the window opening formed by said sub-frame.

10. A method of repairing existing glazing systems of building structures, the method comprising the steps of:

(a) measuring the existing opening of the glazing system;

(b) fabricating a sub-frame and miniframe unique to the measured opening;

(c) bonding said miniframe to a glazing panel;

(d) removing the existing glazing system to expose the existing glazing framework;

(e) mounting said sub-frame to the existing glazing framework, said sub-frame being mounted from the exterior of the building structure;

(f) mounting said miniframe and glazing panel on said sub-frame; and (g) sealing the perimeter of the glazing panel to the building structure substrate.

* * * * *